United States Patent [19]

LePage et al.

[11] Patent Number: 4,862,655

[45] Date of Patent: Sep. 5, 1989

[54] MASS INTERMENT SYSTEM

[76] Inventors: Bernard E. LePage, 1201 Creek View Ct., Rochester, Mich. 48063; Frank Hurless, 1491 Silver Lake Dr., Norcross, Ga. 30093

[21] Appl. No.: 96,908

[22] Filed: Sep. 14, 1987

[51] Int. Cl.[4] ..... F04H 13/00

[52] U.S. Cl. ..... 52/136; 52/131; 52/133

[58] Field of Search ..... 52/128, 131, 132, 133, 52/134, 136

[56] References Cited

U.S. PATENT DOCUMENTS

| | | | |
|---|---|---|---|
| 915,168 | 3/1909 | Fish et al. | 52/132 |
| 1,115,284 | 10/1914 | Collett | 52/132 |
| 1,183,668 | 5/1916 | Rice | 52/132 |
| 1,453,375 | 5/1923 | Allen | 52/134 |
| 4,648,219 | 3/1987 | Johnston, Sr. | 52/131 |
| 4,669,157 | 6/1987 | Schwarten | 52/134 |
| 4,727,632 | 3/1988 | Yearsley | 52/134 |

FOREIGN PATENT DOCUMENTS

| | | | |
|---|---|---|---|
| 206156 | 11/1959 | Austria | 52/134 |
| 2378923 | 9/1978 | France | 52/136 |

*Primary Examiner*—Michael Safavi

*Attorney, Agent, or Firm*—Krass & Young

[57] ABSTRACT

An interment facility including an above-ground building of generally rectangular parallelpiped configuration; a plurality of sealed vaults each containing a single corpse; and a skeleton vault support structure within the building including a plurality of laterally and fore and aft spaced columns, and a plurality of horizontal rails supported by the columns and coacting with the columns to suspend a large quantity of vaults within the interior volume of the building in a series of side-by-side vertical rows each including a plurality of tiers. The vaults are moved into and out of the individual interment spaces by sliding movement into the open end of the rows from a vestibule area within the building with flanges defined along the opposite longitudinal edges of the vaults engaging and sliding along the rails to allow movement of the vaults to their final designated space and to support the vault by its flanges in its final designated space.

1 Claim, 4 Drawing Sheets

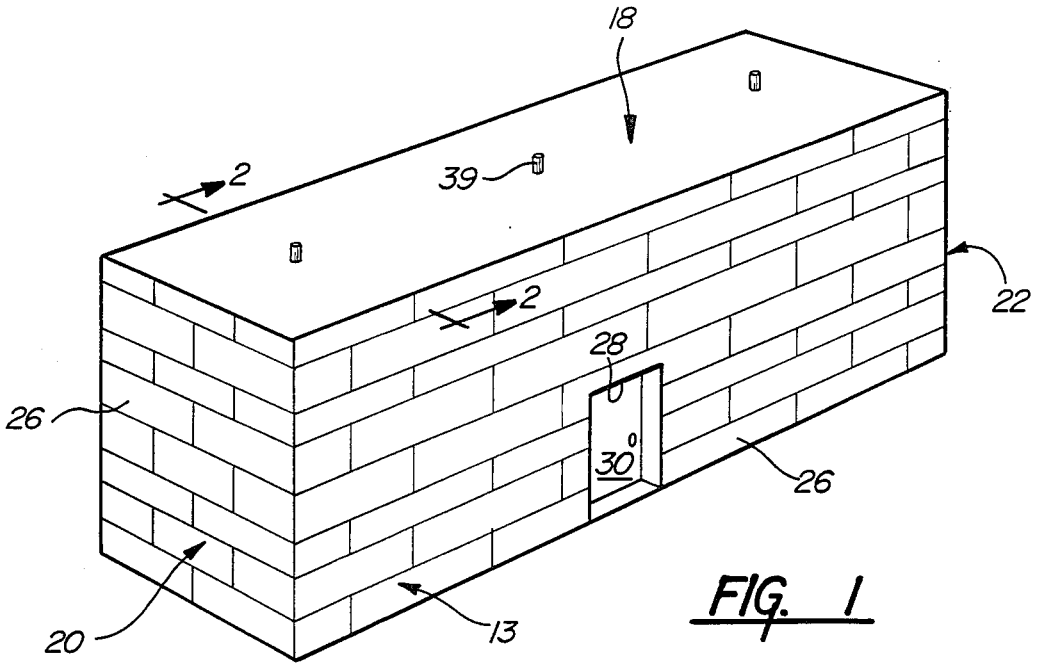
FIG. 1
FIG. 2
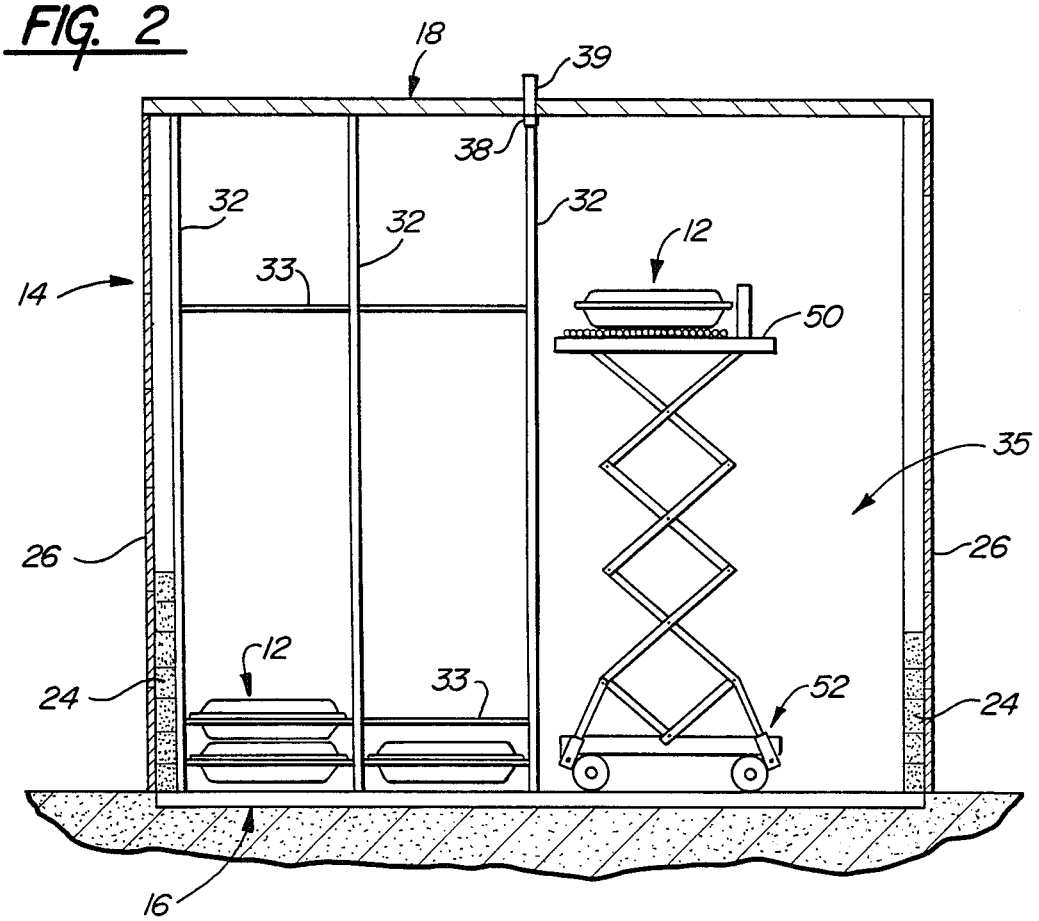

MASS INTERMENT SYSTEM

BACKGROUND OF THE INVENTION

Human interment has typically consisted of either burying the remains below ground or interring the remains in a suitable above-ground structure. Neither system is totally satisfactory. Specifically, below ground burial is offensive to many people and yet above ground interment is typically extremely expensive.

SUMMARY OF THE INVENTION

The present invention is directed to the provision of an inexpensive above-ground interment system for human corpses.

The present invention is further directed to the provision of a system of mass interment that may function in perpetuity to provide appropriate interment for successive batches of corpses.

According to one aspect of the invention methodology, a building is provided defining a large plurality of interment spaces each sized to receive a sealed vault; a sealed vault is spaced in substantially all of the interment spaces; and each vault is allowed to remain in its assigned interment space for a predetermined period of time, whereafter it is removed from its assigned space and from the building, destroyed together with its interred remains, and replaced with a new sealed vault, containing a recent corpse, to occupy the assigned space. This arrangement allows the interment facility to be used over and over again for successive batches of corposes while yet according proper interment for each corpse for a receptacle period of time.

According to another aspect of the invention methodology, all the vaults are removed from the building and destroyed at substantially the same time and thereafter replenished with a new batch of vaults so as to provide an ongoing above-ground interment facility capable of functioning in perpetuity to receive a new batch of vaults after each passage of a predetermined period of time.

The invention interment facility comprises an above-ground building; a plurality of sealed vaults each sized to receive a single corpse; and means defining a large plurality of interment spaces within the building each sized to receive a single vault in horizontal disposition and arranged in a plurality of vertical side-by-side rows with each space in each row being open to the space above and below it and to the spaces alongside of it in adjacent rows. This arrangement avoids the expensive arrangement of prior art mausoleums wherein each interment space is sealed from the other interment spaces.

According to a further feature of the invention, the building is of generally rectangular parallelepiped configuration and includes a front wall, a rear wall, a floor, a ceiling, and side walls; the rows extends substantially from floor to ceiling of the builiding; the side-by-side rows extend substantially from one side wall to the other side wall of the building; and the rows extend forwardly from the rear wall of the building to a location spaced rearwardly from the front wall of the building to define a vestibule area between the front wall and the front border of the rows. This arrangement allows the vaults to be loaded into the rows from the vestibule area.

According to a further feature of the invention, the rows have a length sufficient to accommodate two vaults arranged end to end so as to provide companion spaces for related corpses.

According to a further feature of the invention, the means defining the interment spaces comprise a plurality of vertical columns extending substantially from floor to ceiling of the building in front to rear and side to side spaced relation and a plurality of horizontally extending and vertically spaced rails secured to and supported by the columns extending from the rear wall to the rear border of the vestibule area; and each of the vaults includes flange portions along each longitudinal side thereof adapted to be slidably supported on a pair of adjacent rails. This arrangement provides an inexpensive and convenient structure for guiding the vaults to their final interment space and supporting the vaults in their final interment space.

According to a further feature of the invention, the columns are spaced side to side by a distance slightly greater than the width of the vaults so that a vertical row is defined between each pair of adjacent columns; a first series of rails are secured to one side face of one column of each pair of columns in vertically spaced relation and extend laterally inwardly toward the other column of the pair to respectively slidably receive and support one flange of the vaults received in the row defined between the column pair; and the second series of rails is secured to the confronting side face of the other column of the pair in matching vertically spaced relation and extend laterally inwardly toward the one column to respectively slidably receive and support the other flange of the vaults received in the row defined between the column pairs. This arrangement provides an inexpensive and effective skeleton structure for selectively suspending the vaults within the building.

According to a further feature of the invention, each of the vaults includes an upwardly opening base member having a continuous upper peripheral flange and a downwardly opening lid member having a continuous lower flange sealed to the upper flange of the base member to define the flange portions. This vault construction allows the vaults to be readily slid along and supported by the rails of the support structure.

According to a further feature of the invention, vent means communicate the interior of each vault received in an interment space with the exterior of the building. This arrangement assures that the atmosphere within the building is not polluted by the fumes generated by the decaying corpses.

According to a further feature of the invention, the vent means includes tubular vent members disposed vertically in the building and hose means extending between each vault and the tubular vent members. This arrangement provides a simple and inexpensive means of disposing of the fumes generated within the vaults.

According to a further feature of the invention, the tubular vent members are constituted by certain of the vertical columns supporting the vaults within the building. This arrangement combines the support and venting means in one structure to further minimize the cost of the interment facility.

According to a further feature of the invention, the vestibule area is sufficiently large to accommodate a mobile lift mechanism, and the step of placing the vaults into their assigned spaces comprises engaging the respective vault with the lift mechanism, lifting the vault to a height corresponding to the height of the assigned interment space, and moving the vault lengthwise into the assigned interment space.

BRIEF DESCRIPTION OF THE DRAWINGS

FIG. 1 is a perspective view of the mass interment facility of the invention;

FIG. 2 is a cross-sectional view taken on line 2—2 of FIG. 1;

DETAILED DESCRIPTION OF THE PREFERRED EMBODIMENT

Figure 3:
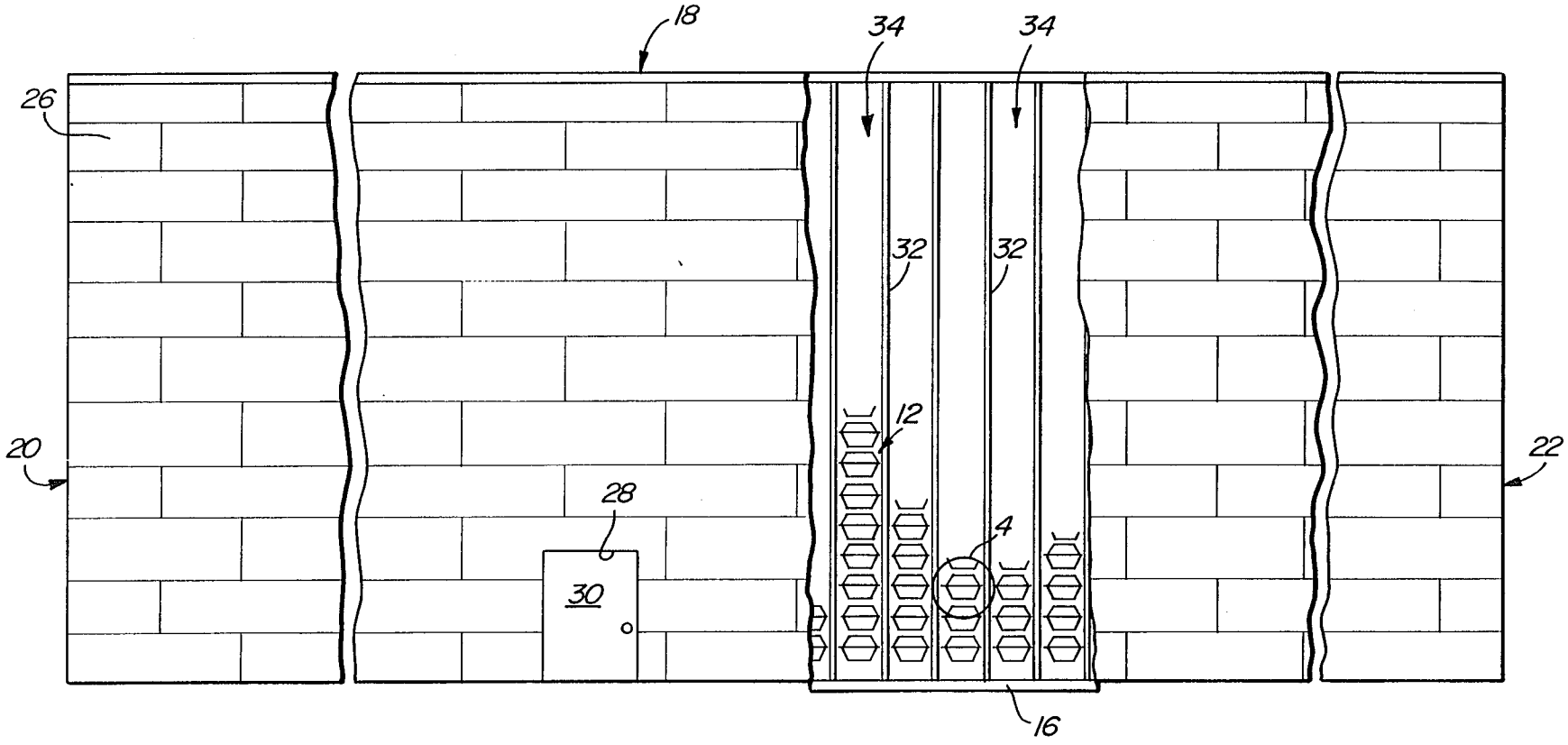
FIG. 3 is a fragmentary front-elevational view of the invention mass interment facility.
Figure 4:
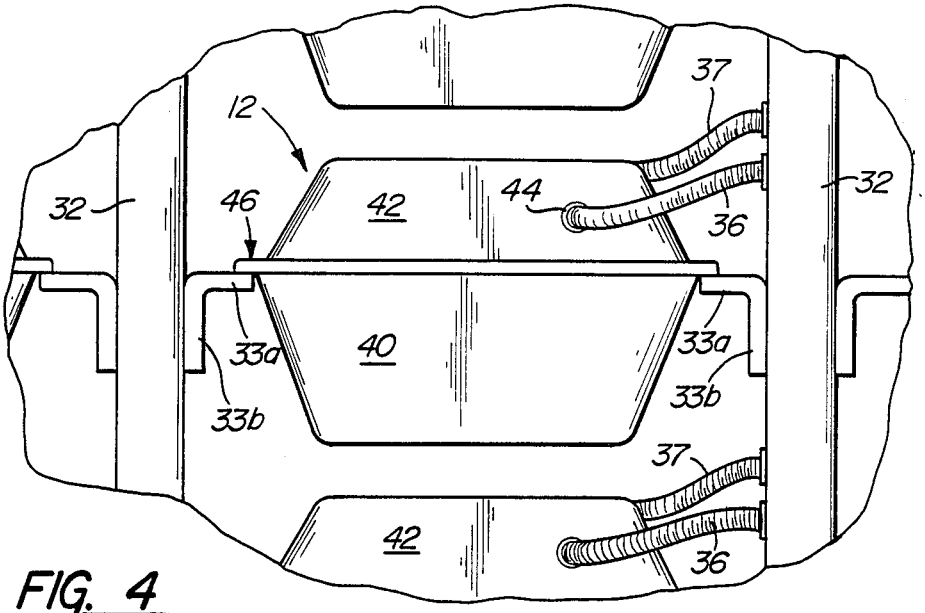
FIG. 4 is a detailed view taken within the Circle 4 of FIG. 3.
Figure 6:
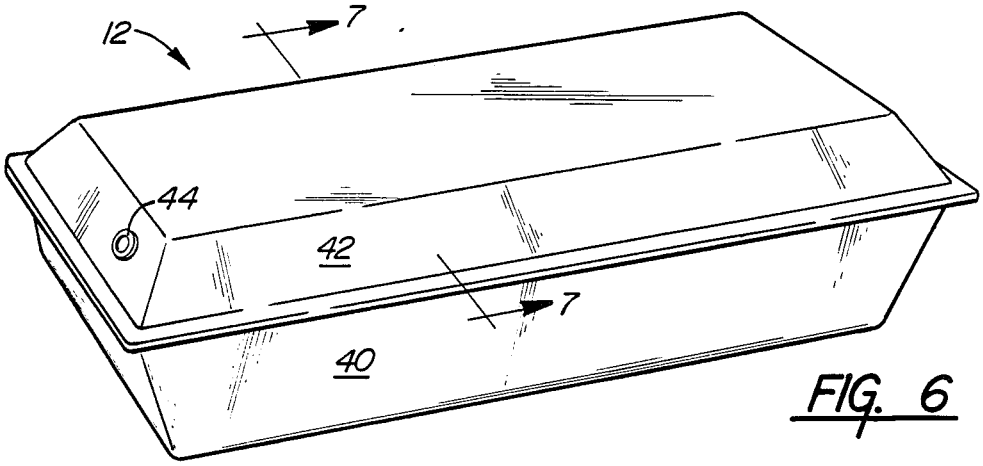
FIG. 6 is a perspective view of a vault used in the invention mass interment facility.
Figure 7:
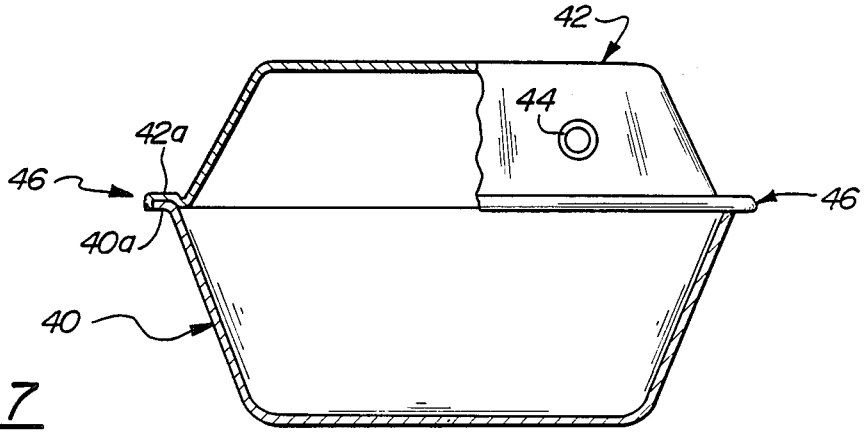
FIG. 7 is a cross-sectional view taken on line 7—7 of FIG. 6.
Figure 5:
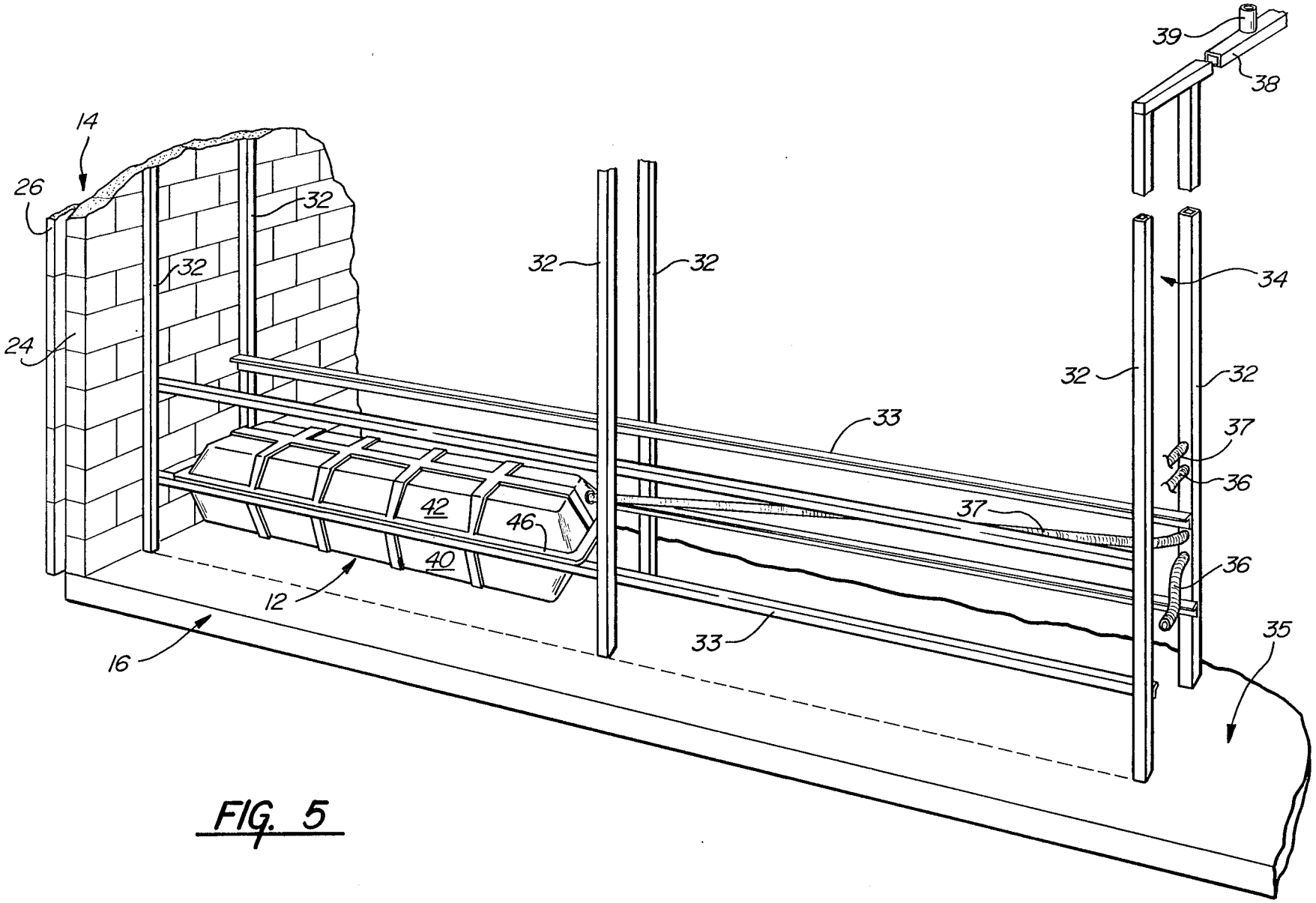
FIG. 5 is a fragmentary schematic perspective view of the invention mass interment facility.

The invention mass interment facility, broadly considered, includes a building 10, a vault support structure 11, and a plurality of vaults 12.

Building 10 has a generally rectangular parallelepiped configuration and includes a front wall 13, a rear wall 14, a floor 16, a ceiling 18 and side walls 20 and 22. Front wall 13, rear wall 14, and side walls 20 and 22 are preferably formed of a plurality of stacked cement or cinder blocks 24 and preferably further include granite plates or slabs 26 suitably secured to the outer faces of the blocks so that the outer walls of the building are encased in granite and the building presents a granite appearance. A portal 28 and door 30 are provided in front wall 13.

Floor 16 preferably comprises a concrete slab, positioned generally flush with the surrounding terrain.

Roof 18 may be formed of any suitable flat truss structure.

Vault support structure 11 has a skeleton configuration and includes a plurality of columns 32 and a plurality of rails 33.

Columns 32 are preferably formed of a suitable fiberglass material and preferably have a hollow rectangular cross-sectional configuration. Columns 32 extend from floor to ceiling of the building in front to rear and side to side spaced relation. The columns are spaces side-to-side by a distance slightly greater than the width of a vault 12 so that a vertical row 34 is defined between each pair of adjacent columns. The rows extend substantially from floor to ceiling of the building and the side-by-side rows extend substantially from one side wall 20 to the other side wall 22 of the building. The number of rows 34 will vary depending upon the desired total capacity of the building.

Each row 34 extends forwardly from the rear wall 14 to a location spaced rearwardly from the front wall 13 to define a vestibule area 35 between the front wall 13 and the front border of the rows 34. The front to rear spacing of the columns 32 may vary but may for example approximate the length of a vault 12 so that, if it is desired to accommodate two vaults arranged end-to-end in each vertical tier of each row, three columns 32 may be provided to define each side of each row with the rearward column secured to the inner face of rear wall 14, the forward column positioned at the rear border of the vestibule area 35, and the intermediate column positioned midway between the forward and rearward columns. Each row is thus defined by a pair of rearward columns, a pair of forward columns, and a pair of intermediate columns.

Rails 33 are preferably formed of fiberglass and have an angle cross-sectional configuration including a horizontal leg portion **33*a* and a vertical leg portion 33*b*. A first series of rails 33 are secured by vertical leg portions 33*b* to one side face of one column of each pair of columns in vertically spaced relation with their horizontal leg portions 33*a* extending laterally inwardly toward the other column of that pair, and a second series of rails are secured by their vertical leg portions 33*b* to the confronting side face of the other column of that pair in matching vertically spaced relation with their horizontal leg portions 33*a* extending laterally inwardly toward the other column of the pair. The rails are spaced vertically by an amount slightly greater than the height of a vault 12** and the number of rails provided will vary depending upon the desired capacity of the facility.

The columns and rails may be secured in place and to each other by any known securement means such as adhesives or fasteners.

A plurality of pairs of short and long hoses 36, 37 are respectively secured at one end thereof to one of the forward columns 32 forming a row 34 with a pair of hoses 36, 37 provided between each vertically spaced set of rails 33 so that a pair of hoses 36, 37 are provided for each vertical tier of each row 34. The columns 32 receiving the hoses 36, 37 are secured at their upper ends to a tubular member 38 secured to the interface of roof 18 and extending from side to side of building 10, and a plurality of roof vents 39 extend from tubular member 38 upwardly through roof 18 to dispose their open upper ends outside of building 10.

Vaults 12 are preferably formed of a suitable fiberglass material and include a base 40 and a lid 42. Base 40 includes a continuous peripheral flange **40*a* and lid 42 includes a continuous peripheral flange 42*a*. Lid 42 further includes a fitting 44 in one end wall thereof communicating with the interior of the lid and adapted to receive the free end of a hose 36, 37 with a snap, bayonet, threaded or other coupling connection. Following placement of a corpse in the base 40, and following the typical funeral service which may for example involve a casket surround for display purposes, the lid 42 is placed over the base 40 and the peripheral flange 42*a* is sealed to the peripheral flange 40*a* to form the final sealed vault assembly and define a continuous flange structure 46** extending around the circumference of the vault.

Following the sealing of the vault, the vault is moved into the interior of building 10 into vestibule area 35. If the vault is intended for placement in one of the lower tiers of the facility, it may be slid directly into the designated space by workmen at either side of the vault with the flange structure 46 along the opposite longitudinal edges of the vault supported on and guiding slidably along the horizontal leg portions **33*a* of the appropriate set of confronting rails 33. If, as shown, each row has a length sufficient to accommodate two vaults, the vault may be positioned in either the rear space or the front space of that row. If the vault is intended for positioning in the rear space of the row, the vault is temporarily positioned in the front space, the relatively long hose 37 is suitably coupled at its free end to the fitting 44 in the lid of the vault, and the vault is slid into the rear space of the tier. If the vault is intended for placement in the front space of the tier, the vault is moved into the front space whereafter the relatively short tube 36 is coupled to the fitting 44 in the lid of the vault. It will be seen that this described arrangement provides communication between the interior of the vaults and the exterior of the building through hoses 36 and 37, columns 32, tubular member 38, and roof vents 39** so that the fumes generated within the vaults upon decomposition of the corpses are efficiently vented to the exterior of the building to preclude contamination of the atmosphere within the building.

If the vault is intended for placement in one of the upper tiers within the building, the vault is placed on the roller bed 50 of a scissors lift truck 52 of known construction and raised by known means to a height corresponding to the height of the designated tier, whereafter workmen positioned on the platform 50 alongside of the vault 12 roll the vault off of the platform to engage the flange structure 46 with the horizontal leg portions 33*a* of the respective set of rails 33, whereafter the appropriate tube 36 or 37 is connected to the fitting 44 in the lid of the vault depending on whether the vault is intended for placement in the rear or front space of the tier.

The number of rows, the number of tiers, and the number of spaces in each tier all determine the total capacity of the building. For example, one hundred rows may be provided, fifteen tiers may be provided, and each row may have a length sufficient to accommodate two vaults in end-to-end relation giving a total facility capacity of 3,000 vaults.

Whereas the vaults may remain in the spaces within the facility in perpetuity, it is contemplated according to the methodology of the invention that the vaults would be replaced after a predetermined period of time with new vaults containing recent corpses. Specifically, the spaces might be sold under a contract that specified that the vaults would remain in the interment facility for a predetermined period of time such as 20 years, whereafter, in accordance with the interment contract, the vault and its interred remains would be removed from the facility and suitably destroyed. The destruction process, again as provided by the contract, could for example comprise cremation of the vault and its remains and placement of the cremated remains in a suitable urn or niche.

According to the methodology of the invention, each interment space within the facility might be separately contracted with the vault to be removed a predetermined number of years after placement of the vault within the facility or, alternatively, spaces within the facility might be sold with the understanding that all of the vaults would be removed from the facility at a predetermined future date, such for example as 20 years from the date when the last vault is placed within the facility to fill the facility to its capacity. With either arrangement, the invention provides an ongoing above-ground interment facility capable of functioning in perpetuity to receive a new batch of vaults after each passage of a predetermined period of time. It will be seen that, for a building having a capacity of 3,000 vaults as previously specified, the invention interment facility could provide the total interment facility for a relatively large population segment in perpetuity with the facility alternately filled with vaults, the vaults allowed to remain as a batch in the facility for a predetermined period of years such as a generation, the batch of vaults thereafter removed and suitably destroyed, and a new batch of vaults installed in the interment spaces to again be removed after the passage of a generation to allow the placement of a new batch in the spaces.

The invention will be seen to provide a facility and a methodology for providing inexpensive above-ground interment for human corpses. Since the building is of relatively simple construction and since a large number of interment spaces are provided within the building, the cost of an individual interment space can be roughly comparable to the cost of typical in-ground burial and, considering that the building may be recycled to accommodate successive batches of vaults in perpetuity, individual spaces may in fact be provided for less than the cost of in-ground burial. The invention facility and methodology may also be seen to provide a solution to the scarcity and high cost of land since the facility occupies a fixed relatively small area of land and may function in perpetuity to provide the interment facilities for a relatively large population segment.

Whereas a preferred embodiment of the invention has been illustrated and described in detail it will be apparent that various changes may be made in the disclosed embodiment without departing from the scope or spirit of the invention.

We claim:

1. A mass above-ground interment facility comprising:

(A) an above ground building;

(B) a plurality of vaults each sized to receive a single corpse;

(C) means defining a large plurality of interment spaces within said building each sized to receive a single vault in horizontal disposition and arranged in a plurality of vertical side-by-side rows with each space in each row being open to the space above and below each piece space and to the spaces along side of each piece space in adjacent rows; and (D) vent means communicating the interior of each vault received in an interment space with the exterior of said building;

(E) said vent means including tubular vent members disposed vertically in said building and hose means extending between each vault and said tubular vent members;

(F) said defining means including a plurality of vertical columns extending substantially from floor to ceiling of said building in front to rear and side to side spaced relation to define said plurality of vertical side-by-side rows of spaces; and (G) at least some of said columns being tubular and constituting said tubular vent members.

* * * * *